US008526647B2

(12) United States Patent
Pedersen et al.

(10) Patent No.: US 8,526,647 B2
(45) Date of Patent: Sep. 3, 2013

(54) LISTENING DEVICE PROVIDING ENHANCED LOCALIZATION CUES, ITS USE AND A METHOD

(75) Inventors: Michael Syskind Pedersen, Smørum (DK); Marcus Holmberg, Smørum (DK); Thomas Kaulberg, Smørum (DK)

(73) Assignee: Oticon A/S, Smorum (DK)

( * ) Notice: Subject to any disclaimer, the term of this patent is extended or adjusted under 35 U.S.C. 154(b) by 601 days.

(21) Appl. No.: 12/791,526

(22) Filed: Jun. 1, 2010

(65) Prior Publication Data

US 2010/0303267 A1 Dec. 2, 2010

Related U.S. Application Data

(60) Provisional application No. 61/183,483, filed on Jun. 2, 2009.

(30) Foreign Application Priority Data

Jun. 2, 2009 (EP) ..... 09161700

(51) Int. Cl.

| | |
|---|---|
| ***H04R 25/02*** | (2006.01) |
| ***H04R 25/04*** | (2006.01) |
| ***H04R 3/04*** | (2006.01) |
| ***H04R 3/10*** | (2006.01) |
| *H04R 25/00* | (2006.01) |
| *H04R 3/00* | (2006.01) |

(52) U.S. Cl.
USPC ..... 381/313; 381/316; 381/320; 381/92

(58) Field of Classification Search
USPC ..... 381/313, 316, 320, 321, 23.1, 312, 381/92
See application file for complete search history.

(56) References Cited

U.S. PATENT DOCUMENTS 5,473,701 A 12/1995 Cezanne et al.
5,870,481 A 2/1999 Dymond et al.

(Continued)

FOREIGN PATENT DOCUMENTS

EP 1 443 798 A2 8/2004
EP 1 579 728 B1 9/2007

(Continued)

OTHER PUBLICATIONS

Blauert et al., "Spatial Hearing: The Psychophysics of Human Sound Localization", Edition 2, revised, The MIT Press, (2), pp. 36-200 (1997).

(Continued)

*Primary Examiner* — Edgardo San Martin
(74) *Attorney, Agent, or Firm* — Birch, Stewart, Kolasch & Birch, LLP

(57) ABSTRACT

A listening device includes an ear-part for being worn in or at an ear of a user, a microphone system including at least two microphones each converting an input sound to an electrical microphone signal, and a TF-conversion unit for providing a time-frequency representation of the at least two microphone signals. Each signal representation includes complex or real values of the signal in a particular time-frequency unit. The listening device also includes a DIR-unit with a directionality system providing a weighted sum of the at least two electrical microphone signals thereby providing at least two directional microphone signals having maximum sensitivity in spatially different directions and a combined microphone signal. Each time-frequency unit of the combined signal is attributable to a particular direction. A frequency shaping-unit modifies one or more selected time-frequency units to indicate directional cues of input sounds providing an improved directional output signal.

18 Claims, 10 Drawing Sheets

(56) References Cited

U.S. PATENT DOCUMENTS

| | | | | |
|---|---|---|---|---|
| 6,522,756 | B1 * | 2/2003 | Maisano et al. | 381/92 |
| 6,539,096 | B1 * | 3/2003 | Sigwanz et al. | 381/313 |
| 7,010,134 | B2 * | 3/2006 | Jensen | 381/313 |
| 7,209,568 | B2 * | 4/2007 | Arndt et al. | 381/313 |
| 7,864,971 | B2 * | 1/2011 | Kjems et al. | 381/312 |
| 7,936,890 | B2 * | 5/2011 | Naylor et al. | 381/313 |
| 8,023,660 | B2 * | 9/2011 | Faller | 381/23 |
| 8,103,030 | B2 * | 1/2012 | Barthel et al. | 381/313 |
| 8,111,848 | B2 * | 2/2012 | Roeck et al. | 381/313 |
| 8,204,263 | B2 * | 6/2012 | Pedersen et al. | 381/313 |
| 8,238,593 | B2 * | 8/2012 | Bisgaard et al. | 381/313 |
| 8,270,643 | B2 * | 9/2012 | Kjems et al. | 381/312 |
| 8,300,861 | B2 * | 10/2012 | Pontoppidan | 381/313 |
| 8,325,954 | B2 * | 12/2012 | Fischer et al. | 381/313 |
| 2003/0156722 | A1 | 8/2003 | Taenzer | |
| 2003/0169891 | A1 | 9/2003 | Ryan et al. | |
| 2006/0251278 | A1 | 11/2006 | Puria et al. | |
| 2007/0061026 | A1 | 3/2007 | Wang | |
| 2007/0230729 | A1 | 10/2007 | Naylor et al. | |
| 2008/0044046 | A1 * | 2/2008 | Knapp et al. | 381/313 |
| 2008/0152167 | A1 | 6/2008 | Taenzer | |
| 2009/0074197 | A1 | 3/2009 | Neher et al. | |
| 2009/0304187 | A1 * | 12/2009 | Dittberner | 381/23.1 |
| 2010/0008515 | A1 * | 1/2010 | Fulton et al. | 381/92 |
| 2011/0299702 | A1 * | 12/2011 | Faller | 381/92 |

FOREIGN PATENT DOCUMENTS

| | | |
|---|---|---|
| WO | WO 99/09786 | 2/1999 |
| WO | WO 2007/137364 A1 | 12/2007 |

OTHER PUBLICATIONS

Middlebrooks, "Individual differences in external-ear transfer functions reduced by scaling in frequency" vol. 106 (3), pp. 1480-1492 (1999).

Wang, "On Ideal Binary Mask As the Computational Goal of Auditory Scene Analysis", Divenyi P (ed): Speech Sepearation by Human and Machines, pp. 181-197 (2005).

Keyrouz et al., "A Novel Approach to Robotic Monaural Sound Localization", AES 122nd Convention, Vienna, Austria, May 5-8, 2007 pp. 1-5.

* cited by examiner

Binary mask BTF: IF | CR(m,p) | - | CF(m,p) | > 0, BTF(m,p) = 1, ELSE BTF(m,p) = 0

| | | | | | | | | | | | | |
|---|---|---|---|---|---|---|---|---|---|---|---|---|
| f1 | 0 | 0 | 0 | 0 | 0 | 0 | 0 | 1 | 1 | 1 | 1 | 1 |
| f2 | 0 | 0 | 0 | 0 | 0 | 0 | 0 | 1 | 1 | 1 | 1 | 1 |
| f3 | 0 | 0 | 0 | 0 | 0 | 0 | 0 | 1 | 1 | 1 | 1 | 1 |
| f4 | 0 | 0 | 1 | 1 | 0 | 0 | 0 | 1 | 0 | 0 | 1 | 1 |
| f5 | 0 | 0 | 1 | 1 | 0 | 0 | 0 | 1 | 0 | 0 | 0 | 1 |
| f6 | 0 | 0 | 0 | 0 | 0 | 0 | 0 | 1 | 1 | 1 | 1 | 1 |
| f7 | 0 | 0 | 0 | 0 | 0 | 0 | 0 | 1 | 1 | 1 | 1 | 1 |
| f8 | 0 | 0 | 0 | 0 | 0 | 0 | 0 | 1 | 1 | 1 | 1 | 1 |
| | t1 | t2 | t3 | t4 | t5 | t6 | t7 | t8 | t9 | t10 | t11 | t12 |

LISTENING DEVICE PROVIDING ENHANCED LOCALIZATION CUES, ITS USE AND A METHOD

Cross Reference to Related Applications:

This nonprovisional application claims the benefit of U.S. Provisional Application No. 61/183,483 filed on Jun. 2, 2009. The entire contents of the above application is hereby incorporated by reference.

TECHNICAL FIELD

The present invention relates to listening devices, e.g. hearing aids, in particular to localization of sound sources relative to a person wearing the listening device. The invention relates specifically to a listening device comprising an ear-part adapted for being worn in or at an ear of a user, a front and rear direction being defined relative to a person wearing the ear-part in an operational position.

The invention furthermore relates to a method of operating a listening device, to its use, to a listening system, to a computer readable medium and to a data processing system.

The invention may e.g. be useful in applications such as listening devices, e.g. hearing instruments, head phones, headsets or active ear plugs.

BACKGROUND ART

The following account of the prior art relates to one of the areas of application of the present invention, hearing aids.

The localization cues for hearing impaired are often degraded (due to the reduced hearing ability as well as due to the configuration of a hearing aid worn by the hearing impaired), meaning a degradation of the ability to decide from which direction a given sound is received. This is annoying and can be dangerous, e.g. in the traffic. The human localization of sound is related to the difference in time of arrival, attenuation, etc. of a sound at the two ears of a person and is e.g. dependent on the direction and distance to the source of the sound, the form and size of the ears, etc. These differences are modelled by the so-called Head-Related Transfer functions (HRTFs). Further, the lack of spectral colouring can make the perception of localization cues more difficult even for monaural hearing aids (i.e. a system with a hearing instrument at only one of the ears).

US 2007/0061026 A1 describes an audio processing system comprising filters adapted for emulating 'location-critical' parts of HRTFs with the aim of creating or maintaining localization related audio effects in portable devices, such as cell phones, PDAs, MP3 players, etc.

EP 1 443 798 A2 deals with a hearing device with a behind-the-ear microphone arrangement where beamforming provides for substantially constant amplification independent of direction of arrival of an acoustical signal at a predetermined frequency and provides above such frequency directivity so as to reestablish a head-related-transfer-function of the individual.

US 2007/230729 A1 deals with a hearing aid system comprising a directional microphone system adapted for generating auditory spatial cues. US 2009/0074197 A1 deals with a method of configuring a frequency transposition scheme for transposing a set of received frequencies of an audio signal received by a hearing aid worn by a subject to a transposed set of frequencies.

A problem in particular with behind-the-ear (BTE) hearing aids is that the microphones are placed above/behind the external ear and thus this attenuation of sounds coming from behind disappears. Front-back confusions are a common problem for hearing impaired users of this kind of hearing aids.

DISCLOSURE OF INVENTION

However, it might be possible to introduce localization cues for the hearing impaired, such as frequency-dependent attenuation or direction-dependent peaks or notches. When comparing the spectrally decomposed front and rear cardioids (see e.g. FIG. 2), good front-rear estimation is obtained. Such a binary front-rear decision can be used to enhance front-rear localization, by applying different frequency shaping to the sound signal depending on whether the signal impinges from the front or the rear.

An object of the present invention is to provide localization cues for indicating a direction of origin of a sound source.

Objects of the invention are achieved by the invention described in the accompanying claims and as described in the following.

A Listening Device:

An object of the invention is achieved by a listening device comprising an ear-part adapted for being worn in or at an ear of a user, a front and rear direction being defined relative to a person wearing the ear-part in an operational position. The listening device comprises (a) a microphone system comprising at least two microphones each converting an input sound to an electrical microphone signal, (b) a DIR-unit comprising a directionality system for providing a weighted sum of the at least two electrical microphone signals thereby providing at least two directional microphone signals having maximum sensitivity in spatially different directions and a combined microphone signal, and (c) a frequency shaping-unit for modifying the combined microphone signal to indicate directional cues of input sounds originating from at least one of said spatially different directions and providing an improved directional output signal.

This has the advantage of providing an alternative or an addition to natural localization cues.

The term 'indicate directional cues' is in the present context taken to mean to 'restore or enhance or replace' the natural directional cues available for a normally hearing person (without significant hearing impairment) under normal hearing conditions (without extremely low or high sound pressure levels). Directional cues in the combined microphone signal of a listening device may be generated by the directional system of the DIR-unit based on the two or more spatially dislocated microphones of the microphone system. Such cues may be identified and transposed to a frequency range appropriate for the user's wearing the listening device. Directional cues in a listening device may alternatively or additionally be artificially generated by the frequency shaping unit based on information from the directional system regarding the location of an acoustic source relative to a user wearing the listening device. Such artificial cues may be adapted in magnitude and frequency (e.g. frequency location and width) according to a user's needs. In an embodiment, the at least two microphones are located in the ear-part adapted for being worn in or at an ear of a user. In an embodiment one of the at least two microphones is located at an opposite ear of the user.

In the term 'an improved directional output signal', 'improved' is used in the sense that the output signal comprises directional information that is aimed at providing an enhanced perception by a user of the listening device.

In an embodiment, the 'weighted sum of the at least two electrical microphone signals' is taken to mean a weighted sum of a complex representation of the at least two electrical microphone signals. In an embodiment, the weighting factors are complex. The 'weighted sum of the at least two electrical microphone signals' includes a linear combination of the at least two input signals with a mutual delay between them. In an embodiment the microphone system comprises two electrical microphone input signals TF1(*f*) and TF2(*f*). A weighted sum of the two electrical microphone signals providing e.g. a front directional signal CF, can thus be written as CF(*f*)=TF1(*f*)·w1F(*f*)+TF2(*f*)·w2F(*f*), where f is frequency and w1F(*f*), w2F(*f*) are (generally complex) weighting functions. Correspondingly, a rear directional signal CR, can be written as CR(*f*)=TF1(*f*)·w1R(*f*)+TF2(*f*)·w2R(*f*). In an embodiment, the weighting functions can be adaptively determined (to achieve that the FRONT and REAR directions are adaptively determined in relation to the present acoustic sources).

In an embodiment, the listening device comprises a synthesis unit comprising a time-frequency to time conversion arrangement providing as an output a time dependent, improved directional output signal comprising enhanced directional cues.

In an embodiment, the listening device comprises an output transducer for presenting the improved directional output signal or a signal derived there from as a stimulus adapted to be perceived by a user as an output sound (e.g. an electroacoustic transducer (a receiver) of a hearing instrument or an output transducer (such as a number of electrodes) of a cochlear implant or (such as a vibrator) of a bone conducting hearing device).

A forward path of a listening device is defined as a signal path from the input transducer (defining an input side) to an output transducer (defining an output side).

In an embodiment, the listening device comprises an analogue to digital (AD) converter unit providing said electrical microphone signals as digitized electrical microphone signals.

In an embodiment, the listening device is adapted to be able to perform signal processing (of the signal of the forward path and/or of a control path influencing the signal of the forward path) in separate frequency ranges or bands.

In an embodiment, the input side of the forward path of the listening device comprises an AD-conversion unit for sampling an analogue electric input signal with a sampling frequency $f_s$ and providing as an output a digitized electric input signal comprising digital time samples $s_n$ of the input signal (amplitude) at consecutive points in time $t_n=n*(1/f_s)$. The duration in time of a sample is thus given by $T_s=1/f_s$. In general, the sampling frequency is adapted to the application (available bandwidth, power consumption, frequency content of input signal, necessary accuracy, etc.). In an embodiment, the sampling frequency $f_s$ is in the range from 8 kHz to 40 kHz, e.g. from 12 kHz to 24 kHz, e.g. around or equal to 16 kHz or 20 kHz.

In an embodiment, the listening device comprises a TF-conversion unit for providing a time-frequency representation of the at least two microphone signals, each signal representation comprising corresponding complex or real values of the signal in question in a particular time and frequency range. In an embodiment, a signal of the forward path and/or a signal branched off from the forward path is available in a time-frequency representation, where a time representation of the signal exists for each of the frequency bands constituting the frequency range considered in the processing (from a minimum frequency $f_{min}$ to a maximum frequency $f_{max}$, e.g. from 10 Hz to 20 kHz, such as from 20 Hz to 12 kHz). A 'time-frequency region' may comprise one or more adjacent frequency bands and one or more adjacent time units.

In an embodiment, a number of consecutive samples $s_n$ are arranged in time frames $F_m$ (m=1, 2, . . . ), each time frame comprising a predefined number Q of digital time samples $s_q$ (q=1, 2, . . . , Q) corresponding to a frame length in time of $L=Q/f_s,=Q\cdot T_s$, each time sample comprising a digitized value $s_n$ (or s[n]) of the amplitude of the signal at a given sampling time $t_n$ (or n). Alternatively, the time frames $F_m$ may differ in length, e.g. according to a predefined scheme.

In an embodiment, successive time frames ($F_m$, $F_{m+1}$) have a predefined overlap of digital time samples. In general, the overlap may comprise any number of samples ≧1. In an embodiment, half of the Q samples of a frame are identical from one frame $F_m$ to the next $F_{m+1}$. In such embodiment, $F_m=\{s_{m,1}, s_{m,2}, s_{m,(Q/2)-1}, s_{m,Q/2}, s_{m,(Q/2)+1}, s_{m,(Q/2)+2}, \ldots, s_{m,Q}\}$ and $F_{m+1}=\{s_{m+1,1}, s_{m+1,2}, \ldots, s_{m+1,(Q/2)-1}, s_{m+1,Q/2}, s_{m+1,(Q/2)+1}, s_{m+1,(Q/2)+2}, \ldots, s_{m+1,Q}\}$, where $s_{m+1,1}=s_{m,(Q/2)+1}$, $s_{m+1,2}=s_{m,(Q/2)+2}, \ldots, s_{m+1,Q/2}=s_{m,Q}$.

In an embodiment, the listening device is adapted to provide a frequency spectrum of the signal in each time frame (m), a time-frequency tile or unit comprising a (generally complex) value of the signal in a particular time (m) and frequency (p) unit. In an embodiment, only the real part (magnitude) of the signal is considered, whereas the imaginary part (phase) is neglected. A 'time-frequency region' may comprise one or more adjacent time-frequency units.

In an embodiment, the listening device comprises a TF-conversion unit for providing a time-frequency representation of a digitized electrical input signal and adapted to transform the time frames on a frame by frame basis to provide corresponding spectra of frequency samples, the time frequency representation being constituted by TF-units each comprising a complex value (magnitude and phase) or a real value (e.g. magnitude) of the input signal at a particular unit in time and frequency. A unit in time is in general defined by the length of a time frame minus its overlap with its neighbouring time frame, e.g. corresponding to the extension in time of the number of new time samples $Q-N_o$ of a given time frame, where $N_o$ is the number of overlapping time samples between a time frame and its previous time frame. In case of no overlap, a time unit is equal to the frame length $L=Q/f_s,=Q\cdot T_s$. A unit in frequency is defined by the frequency resolution of the time to frequency conversion unit. The frequency resolution may vary over the frequency range considered, e.g. to have an increased resolution at relatively lower frequencies compared to at relatively higher frequencies.

In an embodiment, the listening device is adapted to provide that the spatially different directions are said front and rear directions.

In an embodiment, the DIR-unit is adapted to detect from which of the spatially different directions a particular time frequency region or TF-unit originates. This can be achieved in various different ways as e.g. described in U.S. Pat. No. 5,473,701 or in WO 99/09786 A1.

In an embodiment, the spatially different directions are adaptively determined, cf. e.g. U.S. Pat. No. 5,473,701 or EP 1 579 728 B1.

In an embodiment, the frequency shaping unit is adapted to apply directional cues, which would naturally occur in a given time frequency range, in a relatively lower frequency range. In an embodiment, the frequency shaping-(FS-) unit is adapted to apply directional cues of a given time frame, occurring naturally in a given frequency region or unit, in relatively lower frequency regions or frequency units. In the present context, a 'relatively lower frequency region or frequency unit' compared to a given frequency region or unit (at a given time) is taken to mean a frequency region or unit representing a frequency $f_x$ that is lower than the frequency $f_p$ at the given time or time unit (i.e. has a lower index x than the frequency $f_p$ (x<p) in the framework of FIG. 3).

In an embodiment, the applied directional cues are increased in magnitude compared to naturally occurring directional cues. In an embodiment, the increase is in the range from 3 dB to 30 dB, e.g. around 10 dB or around 20 dB.

In an embodiment, differences in the microphone signals from different directions (e.g. front and rear) attributable to directional cues are moved from the naturally occurring, relatively higher, frequencies to relatively lower frequencies or frequency units. The microphones may be located at the same ear or, alternatively, at opposite ears of a user.

In an embodiment, the directional cues (e.g. a number Z of notches located at different frequencies, $f_{N1}$, $f_{N2}$, $f_{Nz}$) are modeled and applied at relatively lower frequencies than the naturally occurring frequencies. In an embodiment, the notches inserted at relatively lower frequencies have the same frequency spacing as the original ones. In an embodiment, the notches inserted at relatively lower frequencies have a compressed frequency spacing. This has the advantage of allowing a user to perceive the cues, even while having a hearing impairment at the frequencies of the directional cues. In an embodiment, the directional cues are increased in magnitude (compared to their natural values). In an embodiment, the magnitude of a notch is in the range from 3 dB to 30 dB, e.g. 3 dB to 5 dB or 10 dB to 30 dB.

In an embodiment, the notches are wider in frequency than corresponding naturally occurring notches. In an embodiment, the width in frequency and/or magnitude of a notch applied as a directional cue is determined depending on a user's hearing ability, e.g. frequency resolution or audiogram. In an embodiment, the notches (or peaks) extend over more than one frequency band in width. In an embodiment, the notches (or peaks) are up to 500 Hz in width, such as up to 1 kHz in width, such as such as up to 1.5 kHz or 2 kHz or 3 kHz in width. In an embodiment, the width of a peak or notch is adjusted during fitting of a listening device to a particular user's needs.

In general the frequency shaping can be performed on any weighted (e.g. linear) combination of the input electrical microphone signals, here termed 'the combined microphone signal' (e.g. $TF\mathbf{1}(f)\cdot w\mathbf{1}c(f)+TF\mathbf{2}(f)\cdot w\mathbf{2}c(f)$). The resulting signal after the frequency shaping is here termed the 'improved directional signal' (even if the combined microphone signal is (chosen to be) an omni-directional signal, 'directional' here relating to the directional cues). In an embodiment, the signal wherein the frequency shaping is performed is a signal, which is intended for being presented to a user (or chosen for further processing with the aim of later presentation to a user). In an embodiment, the frequency shaping is performed on one of the input microphone signals or on one of the directional microphone signals provided by the DIR-unit or on weighted combinations thereof. In an embodiment, the FS-unit is adapted to modify one or more selected TF-units or ranges to provide a directional frequency shaping of the combined microphone signal in dependence of the direction of the incoming sound signal.

In an embodiment, the FS-unit is adapted to provide that different frequency shaping is applied to the combined microphone signal based on a (binary or non-binary) decision of whether a particular instance in time and frequency (a TF-bin or unit) has its origin from a particular direction, e.g. the front of the back of the user. This has the advantage of restoring or enhancing the natural front-back cues. In an embodiment, the FS-unit is adapted to implement a decision algorithm for deciding whether or not (or with which probability or weight) a given TF-range or unit is associated with a given spatial direction. In an embodiment, the decision algorithm (for each TF-range or unit) is $|CF|-|CR|\geqq\tau$, in a logarithmic expression, where |CF| and |CR| are the magnitudes of the front and rear directional signals, respectively, and $\tau$ is a (directional) bias constant. The algorithm can e.g. be interpreted in a binary fashion to indicate that the signal component of that TF-range or unit is assumed to originate from a FRONT direction, if the expression is TRUE, and the signal is assumed to originate from a REAR direction, if the expression is FALSE. Alternatively, a continuous interpretation can be applied, e.g. in that the (possibly normalized) value of the expression $|CF|-|CR|-\tau$ is used as a measure of the probability or weight with which the TF-range or unit in question belongs to a given spatial direction (positive values indicating FRONT and negative values indicating REAR).

In an embodiment, the FS-unit is adapted to provide the directional frequency shaping of the combined microphone signal in dependence of a users hearing ability, e.g. an audiogram or depending on the user's frequency resolution. Preferably, the directional cues are located at frequencies, which are adapted to a user's hearing ability, e.g. located at frequencies where the user's hearing ability is acceptable. In an embodiment, the specific directional frequency shaping (representing directional cues) is determined during fitting of a listening device to a particular user's needs.

In an embodiment, the directional frequency shaping of the combined microphone signal comprises a 'roll off' corresponding to a specific direction, e.g. a rear direction, of the user above a predefined ROLL-OFF-frequency $f_{roll}$, e.g. above 1 kHz, such as above 1.5 kHz, such as above 2 kHz, such as above 3 kHz, such as above 4 kHz, such as above 5 kHz, such as above 6 kHz, such as above 7 kHz, such as above 8 kHz. In an embodiment, the predefined roll off frequency is adapted to a user's hearing ability, to ensure sufficient hearing ability at the roll off frequency. The term 'roll off' is in the present context taken to mean 'decrease with increasing frequency', e.g. linearly on a logarithmic scale.

In an embodiment, the directional frequency dependent shaping comprises inserting a peak or a notch at a REAR-frequency in the resulting improved directional output signal indicative of sound originating from a rear direction of the user. In an embodiment, the REAR-frequency is larger than or equal to 3 kHz, e.g. around 3 kHz or around 4 kHz. In an embodiment, the directional frequency dependent shaping is ONLY performed for sounds originating from a rear direction of the user. In an embodiment, directional frequency dependent shaping comprises inserting a peak or a notch at a FRONT-frequency in the resulting improved directional output signal indicative of sound originating from a front direction of the user. In an embodiment, the FRONT-frequency is larger than or equal to 3 kHz, e.g. around 3 kHz or around 4 kHz.

In an embodiment, the peaks or notches deviate from a starting level by a predefined amount, e.g. by 3-30 dB, e.g. by 10 dB.

In an embodiment, the peaks or notches are inserted in a range from 1 kHz, to 5 kHz.

In an embodiment, the ear-part comprises a BTE-part adapted to be located behind an ear of a user, the BTE-part comprising at least one microphone of the microphone system. In an embodiment, the ear-part comprises the at least two microphones of the microphone system. In an embodiment, the BTE-part comprises the at least two microphones of the microphone system.

In an embodiment, the listening device comprises a hearing instrument adapted for being worn at or in an ear and providing a frequency dependent gain of an input sound. In an embodiment, the hearing instrument is adapted for being worn by a user at or in an ear. In an embodiment, the hearing instrument comprises a behind the ear (BTE) part adapted for being located behind an ear of the user, wherein at least one microphone (e.g. two microphones) of the microphone system is located in the BTE part. In an embodiment, the hearing instrument comprises an in the ear (ITE) part adapted for being located fully or partially in the ear canal of the user. In an embodiment, at least one microphone of the microphone system is located in the ITE part. In an embodiment, the hearing instrument comprises an input transducer (e.g. a microphone) for converting an input sound to en electric input signal, a signal processing unit for processing the input signal according to a user's needs and providing a processed output signal and an output transducer (e.g. a receiver) for converting the processed output signal to an output sound. In an embodiment, the hearing instrument comprises a noise reduction system (e.g. an anti-feedback system). In an embodiment, the hearing instrument comprises a compression system.

In an embodiment, the listening device is a low power, portable device comprising its own energy source, e.g. a battery.

In an embodiment, the listening device comprises an electrical interface to another device allowing reception (or interchange) of data (e.g. directional cues) from the other device via a wired connection. The listening device may, however, in a preferred embodiment comprise a wireless interface adapted for allowing a wireless link to be established to another device, e.g. to a device comprising a microphone contributing to the localization of audio signals (e.g. a microphone of the microphone system). In an embodiment, the other device is a physically separate device (from the listening device, e.g. another body-worn device). In an embodiment, the microphone signal from the other device (or a part thereof, e.g. one or more selected frequency ranges or bands or a signal related to localization cues derived from the microphone signal in question) is transmitted to the listening device via a wired or wireless connection. In an embodiment, the other device is the opposite hearing instrument of a binaural fitting. In an embodiment, the other device is an audio selection device adapted to receive a number of audio signals and to transmit one of them to the listening device in question. In an embodiment, localization cues derived from a microphone of another device is transmitted to the listening device via an intermediate device, e.g. an audio selection device. In an embodiment, a listening device is able to distinguish between 4 spatially different directions, e.g. FRONT, REAR, LEFT and RIGHT. Alternatively, a directional microphone system comprising more than two microphones, e.g. 3 or 4 or more microphones can be used to generate more than 2 directional microphone signals. This has the advantage that the space around a wearer of the listening device can be divided into e.g. 4 quadrants, allowing different directional cues to be applied indicating signals originating from e.g. LEFT, REAR, RIGHT directions relative to a user, which greatly enhances the orientation ability of a wearer relative to acoustic sources. In an embodiment, the applied directional cues comprise peaks or notches or combinations of peaks and notches, e.g. of different frequency, and/or magnitude, and/or width to indicate the different directions.

In an embodiment, the listening device comprises an active ear plug adapted for protecting a person's hearing against excessive sound pressure levels. In an embodiment, the listening device comprises a headset and/or an earphone.

A Listening System:

A listening system comprising a pair of listening devices as described above, in the detailed description of 'mode(s) for carrying out the invention' and in the claims is furthermore provided. In an embodiment, the listening system comprises a pair of hearing instruments adapted for aiding in compensating a persons hearing impairment on both ears. In an embodiment, the two listening devices are adapted to be able to exchange data (including microphone signals or parts thereof, e.g. one or more selected frequency ranges thereof), preferably via a wireless connection, e.g. via a third, intermediate, device, such as an audio selection device. This has the advantage that location related information (localization or directional cues) can be better extracted (due to the spatial difference of the input signals picked up by the two listening devices).

A Method:

A method of operating a listening device, the listening device comprising an ear-part adapted for being worn in or at an ear of a user, a front and rear direction being defined relative to a person wearing the ear-part in an operational position is furthermore provided by the present invention. The method comprises (a) providing at least two microphones signals, each being an electrical representation of an input sound, (b) providing a weighted sum of the at least two electrical microphone signals resulting in at least two directional microphone signals having maximum sensitivity in spatially different directions, e.g. in said front and rear directions, and a combined microphone signal and (c) modifying the combined microphone signal to indicate the directional cues of input sounds originating from at least one of said spatially different directions and providing an improved directional output signal.

It is intended that the structural features of the listening device described above, in the detailed description of 'mode(s) for carrying out the invention' and in the claims can be combined with the method, when appropriately substituted by a corresponding process. Embodiments of the method have the same advantages as the corresponding listening device.

In an embodiment, the method comprises providing the at least two electrical microphone signals in a digitized form and providing a time-frequency representation of said digitized electrical microphone signals, said time frequency representation being constituted by TF-units each comprising a complex or real value of the microphone signal in question at a particular unit in time and frequency. One or more of the digitized electrical microphone signals may originate from a device separate from the listening device in question.

Use of a Listening Device:

Use of a listening device as described above, in the detailed description of 'mode(s) for carrying out the invention' and in the claims is moreover provided by the present invention. In particular embodiments, use in a hearing instrument, in an active ear plug or in a pair of ear phones or in a head set is provided. In an embodiment, the listening device is used in a gaming situation to enhance localization cues in connection with a computer game.

A Computer-Readable Medium:

A tangible computer-readable medium storing a computer program comprising program code means for causing a data processing system to perform at least some of the steps (e.g. at least steps (b) and (c)) of the method described above, in the detailed description of 'mode(s) for carrying out the invention' and in the claims, when said computer program is executed on the data processing system is furthermore provided by the present invention.

A Data Processing System:

A data processing system comprising a processor and program code means for causing the processor to perform at least some of the steps (e.g. at least steps (b) and (c)) of the method described above, in the detailed description of 'mode(s) for carrying out the invention' and in the claims is furthermore provided by the present invention.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

The shape of the external ears influences the attenuation of sounds coming from behind. The attenuation is frequency dependent and is typically larger at higher frequencies.

A problem in particular with behind-the-ear (BTE) hearing aids is that the microphones are placed above/behind the external ear and thus this attenuation of sounds coming from behind disappears (cf. e.g. FIG. 8). Front-back confusions are a common problem for hearing impaired users of this kind of hearing aids. It is proposed to compensate for that by applying different frequency shaping based on a decision (possibly binary) of whether a particular instance in time and frequency (a TF-bin or unit) has its origin from the front of the back of the user, thus restoring or enhancing the natural front-back cues.

The terms 'front-back' and 'front-rear' are used interchangeably with no intended difference in meaning.

A further possibility is to not just compensate for the BTE placement, but to further increase the front-back difference, e.g. by increasing the front-back difference further down in frequencies. An enhanced front-back difference would correspond to increasing the size of the listener's pinna (like when people place their hands behind the ear in order to focus attention on the speaker in front of them). This suggestion could be used with any hearing aid style. It is useful in particular for hearing impaired persons because they often loose high-frequency hearing, and the normal-sized pinna has a frequency shaping effect that is confined mainly to high frequencies.

The subject, often referred to as 'the cone of confusion', is e.g. discussed in [Blauert et al., 1997], page 179.

Figure 1:
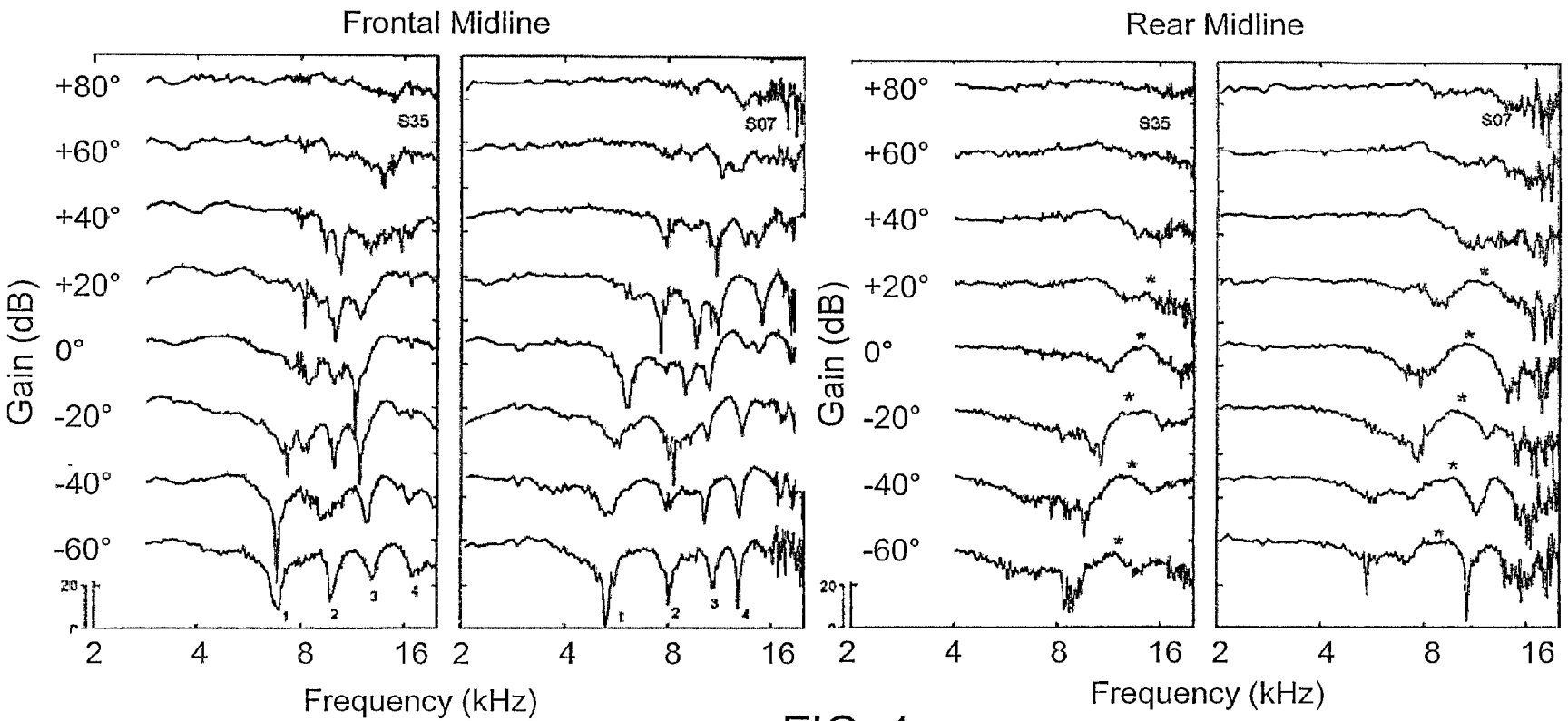
FIG. 1 shows directional transfer functions for the right ears of two subjects with small (first and third panels) and large pinnae (second and fourth panels), respectively (from [Middlebrooks, 1999])

FIG. 1 shows directional transfer functions for the right ears of two subjects with small (first and third panels) and large pinnae (second and fourth panels), respectively (from [Middlebrooks, 1999]). Left panels show responses for different elevation angles along the frontal midline, and right panels show responses for different elevation angles along the rear midline. 0° corresponds to a source at the same horizontal plane as the ears, and positive angles to positions above that plane. The transfer functions are similar among subjects, but might be offset in frequency due to different physical dimensions. If one looks at typical head-related transfer functions, there is a clear spectral shape difference between front (FIG. 1, left panels) and back (FIG. 1, right panels). The difference is clearest at the median plane (0° elevation), and mainly confined to frequencies above 5 kHz. The preferred implementation would try to restore these high-frequency spectral cues. Such restoration could e.g. be established taking account of a user's hearing ability. Typically a restoration at lower frequencies, where a user has better hearing ability, is preferable. Depending on the user's hearing profile, an amplification of the restored directional information can be performed.

Alternatively or additionally, new front-back cues can be introduced. E.g. if the sound impinges from the front, a notch (or a peak) at 3 kHz can be applied, and/or if the sound arrives from behind, a notch (or a peak) at 4 kHz can be applied. When exposed to such a direction-dependent frequency shaping for some time, the hearing impaired will be able to learn to distinguish between sounds impinging from the front and the rear direction. This artificial frequency dependent shaping can also be made dependent on the particular user's hearing ability, e.g. frequency resolution and/or the shape of the audiogram of the user. Artificial cues can for instance be used for users with virtually no residual high-frequency hearing, and independent of device style (i.e. NOT confined to BTE-type devices).

Figure 2:
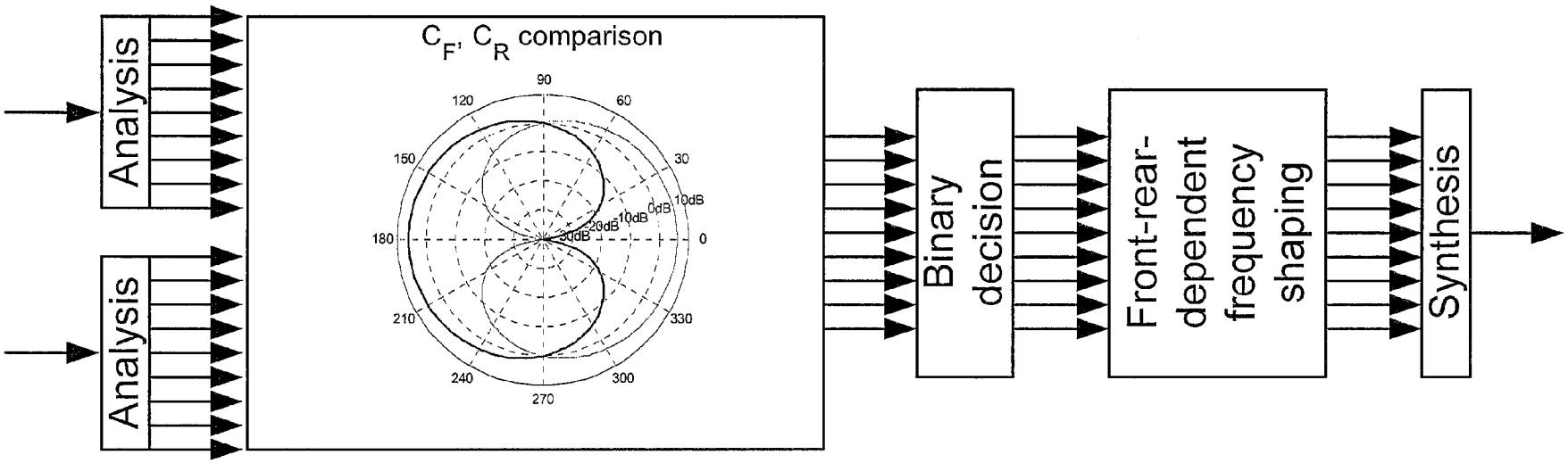
FIG. 2 shows parts of a listening device according to an embodiment of the invention, FIG. 3 schematically shows a time-frequency mapping of a time dependent input signal.

An example of such a directional cue-introducing system is illustrated in FIG. 2. FIG. 2 shows parts of a listening device according to an embodiment of the invention. Electrical signals IN1 and IN2 representing sound inputs as e.g. picked up by two microphones are fed to each their Analysis unit for providing a time to frequency conversion (e.g. as implemented by a filter bank or a Fourier transformation unit). The outputs of the Analysis units comprise a time-frequency representation of the input signals IN1 and IN2, respectively. In the directional unit termed $C_F$, $C_R$ comparison in FIG. 2, directional signals CF and CR are created, each being a weighted combination of the (time frequency representation of the) input signals IN1 and IN2 and representing outputs of a front aiming and rear aiming microphone sensitivity characteristic (cardioid), respectively. By comparing a front and a rear cardioid, it is possible to determine if a sound impinges from the front or from the rear direction. In practice, the time frequency representations of signals CF and CR are compared and a differential time frequency (TF) map is generated based on a predefined criterion. Each TF-map comprises the magnitude and/or phase of CF (or CR) at different instances in time and frequency. Preferably, a time frequency map comprises TF-units (m,p) covering the time and frequency ranges considered for the application in question. In the following, the respective TF-maps of CF and CR are assumed to comprise only the magnitudes $|\bullet|$ of the signals. The output of the directional unit termed $C_F$, $C_R$ comparison unit in FIG. 2, are the TF maps of signals CF and CR comprising respective magnitudes (or gains) of CF and CR, which are fed to the Binary decision unit comprising an algorithm for deciding the direction of origin of a given TF-range or unit.

One algorithm for a given TF-range or unit can e.g. be IF ($|CF|-|CR| \geqq \tau$, in a logarithmic expression), the signal component of that range or unit is assumed to originate from a FRONT direction; otherwise, the signal is assumed to originate from a REAR direction. In general the real constant $\tau$ in dB determines the focus of the application (e.g. the polar angle used to distinguish between FRONT and REAR), positive values of $\tau$ [dB] indicating a focus in the FRONT direction, negative values of $\tau$ [dB] indicating a focus in the REAR direction. In an embodiment, the threshold value $\tau$ equals 0 [dB]. Values different from 0 [dB] can e.g. be founded on one of the signals being better estimated or more accurate than another. Such a decision can in general be gradual (e.g. comprising several steps between FRONT and REAR). In an embodiment, the decision is binary (as indicated by the Binary decision unit of FIG. 2). A corresponding algorithm can e.g. be IF ($|CF(m,p)|-|CR(m,p)| \geqq \tau$), BTF(m,p)=1; otherwise BTF(m,p)=0. In an embodiment, the threshold value $\tau$ equals 0 [dB]. The output of the Binary decision unit is such binary BTF-map holding a binary representation of the origin of each TF-unit. The output is, e.g. together with the TF maps of signals CF and/or CR and/or another weighted combination of the electric microphone signals, fed to a frequency shaping unit (cf. Front-rear-dependent frequency shaping unit in FIG. 2). In the frequency shaping unit, a localization cue is introduced and/or re-established by applying a certain frequency-shaping when the sound impinges from the front and/or another frequency-shaping when the sound impinges from the rear direction. In general, a map of gains (magnitudes) of the chosen signal (a directional or omni-directional signal) to be used as a basis for further processing (e.g. presentation to a user) can be multiplied by a chosen cue gain map. A FRONT cue gain map $GC_{front}(G_{f1}, G_{f2}, \ldots, G_{fP})$ can e.g. be multiplied on the $BTF_{front}(m,p)$ map to provide a $GC_{front}(m,p)$ map and/or a REAR cue gain map $GC_{rear}(G_{r1}, G_{r2}, \ldots, G_{rP})$ can e.g. be multiplied on the $BTF_{rear}(m,p)$ map ($BTF_{rear}(m,p)=1(m,p)-BTF_{front}(m,p)$) to provide a $GC_{rear}(m,p)$ map. The $GC_{front}(m,p)$ map is e.g. generated by vector multiplying the $GC_{front}$ vector with each column of the $BTF_{front}(m,p)$ map. If, e.g., we want to introduce a rear cue in a resulting directional microphone signal (comprising a weighted sum of the input microphone signals), the $GC_{rear}(m,p)$ map is multiplied on the $G_{dir}(m,p)$ map of the directional microphone signal providing an improved directional output signal $G_{imp\text{-}dir}(m,p)$, where $G_{imp\text{-}dir}(m,p)=G_{dir}(m,p)\cdot GC_{rear}(m,p)$. In an embodiment, the directional microphone signal has a preferred (e.g. front aiming) directional sensitivity. In an embodiment, the directional microphone signal is an omni-directional signal comprising the sum of the individual input microphone signals (here IN1(*f*) and IN2(*f*)). In the embodiment of FIG. 2, the improved directional output signal is the output of the Front-rear-dependent frequency shaping unit. This output signal is fed to a Synthesis unit comprising a time-frequency to time conversion arrangement providing as an output a time dependent, improved directional output signal comprising enhanced directional cues. The improved directional output signal can be presented to a user via an output transducer or be fed to a signal processing unit for further processing (e.g. for applying a frequency dependent gain according to a user's hearing profile), cf. e.g. FIG. 4.

Figure 3:
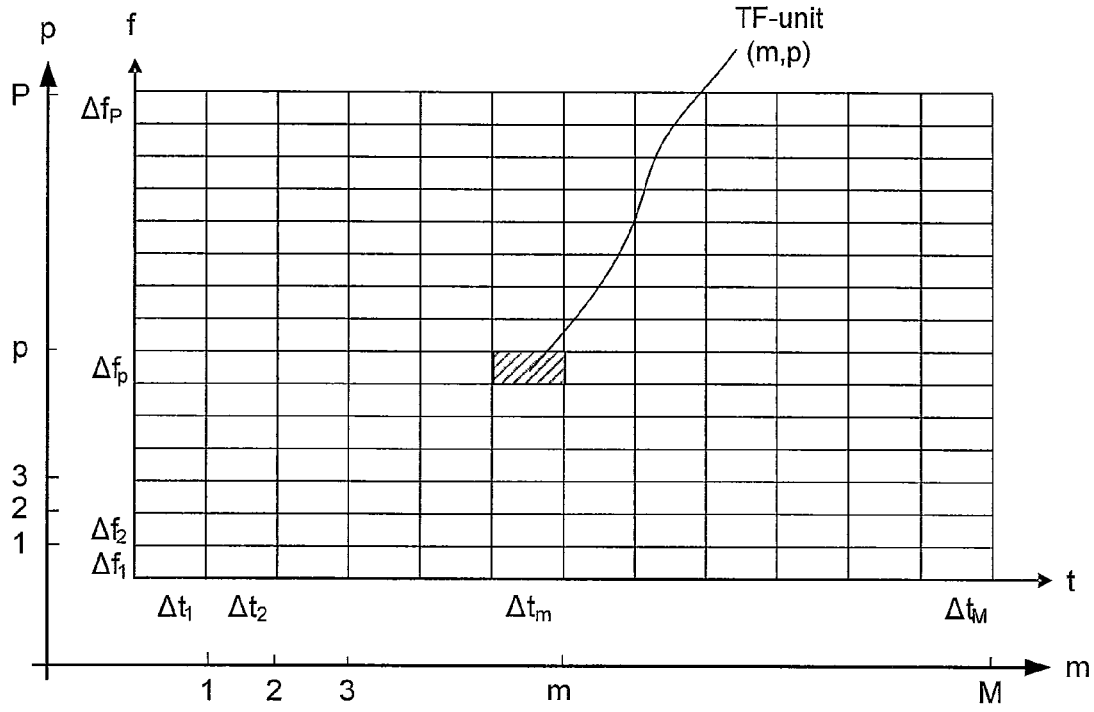

FIG. 3 shows a time-frequency mapping of a time dependent input signal. An AD-conversion unit samples an analogue electric input signal with a sample frequency $f_s$ and provides a digitized electrical signal $x_n$. The digitized electrical signal $x_n$ is e.g. arranged in time frames each comprising a predefined number Q of digital time samples $x_q$ (q=1, 2, . . . , Q), corresponding to a frame length in time of $L=Q/f_s$, where $f_s$ is the sampling frequency of the AD-conversion unit. A number of consecutive time frames are stored in a memory. A time-frequency representation of the digitized signal is provided by transforming the stored time frames on a frame by frame basis to generate corresponding spectra of frequency samples, the time frequency representation being constituted by TF-units (cf. TF-unit(m,p) in FIG. 3) each comprising a generally complex value of the input signal at a particular unit in time $\Delta t$ and frequency $\Delta f$. FIG. 3 shows a M×P map comprising a number of M time units $\Delta t_m$, m=1, 2, . . . , M, each comprising a number of P frequency units $\Delta f_p$, p=1, 2, . . . , P. In general, the complex value of each TF-unit comprises real (magnitude) and imaginary parts (phase angle) of the input signal in the particular time and frequency unit ($\Delta t_m$, $\Delta f_p$). In an embodiment, only the magnitude of the signal is considered.

Figure 4:
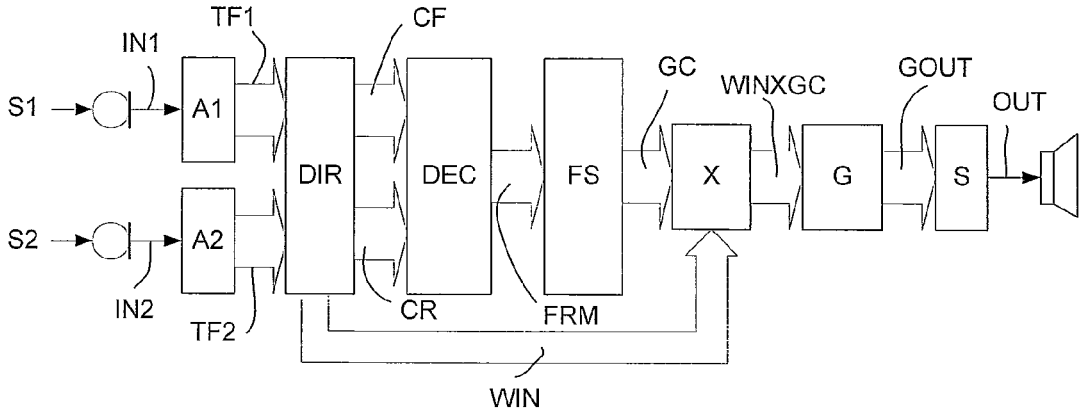
FIG. 4 shows a listening device according to an embodiment of the invention, FIG. 5 schematically illustrates an example of FRONT (FIG. 5*a*) and REAR directional cues (FIG. 5*b*) and a directional time-frequency representation of an input signal (FIG. 5*c*) according to an embodiment of the invention.

FIG. 4 shows a listening device according to an embodiment of the invention. The listening device comprises a microphone system comprising two (e.g. omni-directional)

microphones receiving input sound signals S1 and S2, respectively. The microphones convert the input sound signals S1 and S2 to electric microphone signals IN1 and IN2, respectively. The electric microphone signals IN1 and IN2 are fed to respective time to time-frequency conversion units A1, A2. In the present embodiment, time to time-frequency conversion units A1, A2 provide time-frequency representations TF1, TF2, respectively of the electric microphone signals IN1 and IN2 (cf. e.g. FIG. 3). The time-frequency representations TF1, TF2, are fed to a directionality unit DIR comprising a directionality system for providing a weighted sum of the at least two electrical microphone signals resulting in at least two directional microphone signals CF, CR having maximum sensitivity in spatially different directions, here FRONT and REAR directions relative to a user's face. The (time-frequency representations of the) output signals CF, CR of the DIR-unit are fed to a decision unit DEC for estimating on a unit by unit basis whether a particular time frequency component has its origin from a mainly FRONT or mainly REAR direction. In the present embodiment, the time-frequency representations of signals CF and CR are compared and a differential time frequency (TF) map FRM (e.g. a binary map, BTF) is generated based on a predefined criterion. The output (signal or TF-map FRM) of the decision unit DEC is fed to a frequency shaping-unit FS for to generate the directional cues of input sounds originating from said spatially different directions (here FRONT and REAR) and providing an output signal GC comprising the introduced gain cues (e.g. FRONT gain cues and/or REAR gain cues applied to the differential time frequency (TF) map FRM). The output signal(s) GC from the frequency shaping unit FS are fed to a multiplication unit X (alternatively included in the FS-unit), wherein the output signal(s) GC comprising the introduced gain cues is/are multiplied to the corresponding directional signal WIN comprising a weighted sum of the microphone signals (or rather of TF-representation thereof), here extracted from the D/R-unit: $WIN(f)=TF1(f)\cdot w1(f)+TF2(f)\cdot w2(f)$, where f is frequency and $w1(f)$, $w2(f)$ are weighting functions, which in an embodiment can be adaptively determined (to achieve that the FRONT and REAR directions are adaptively determined in relation to the present acoustic sources). The resulting output WINXGC of the multiplication unit X represents an improved directional output signal comprising new, improved and/or reestablished directional cues. In the embodiment of FIG. 4, this signal is fed to a signal processing unit G for further processing the improved directional output signal WINXGC, e.g. introducing further noise reduction, compression and/or anti feedback algorithms and/or for providing a frequency dependent gain according to a particular user's needs. The output GOUT of the signal processing unit G is fed to a synthesis unit S for converting the time frequency representation of the output GOUT to a time domain output signal OUT, which is fed to a receiver for being presented to a user as an output sound. In embodiments, one or more of the processing algorithms are introduced before the introduction of localization cues.

In the embodiment of FIG. 4, the order of the time to time-frequency conversion units A1, A2 and the directionality unit DIR may alternatively be switched, so that directional signals are created before a time to time-frequency conversion is performed.

Figure 5A:
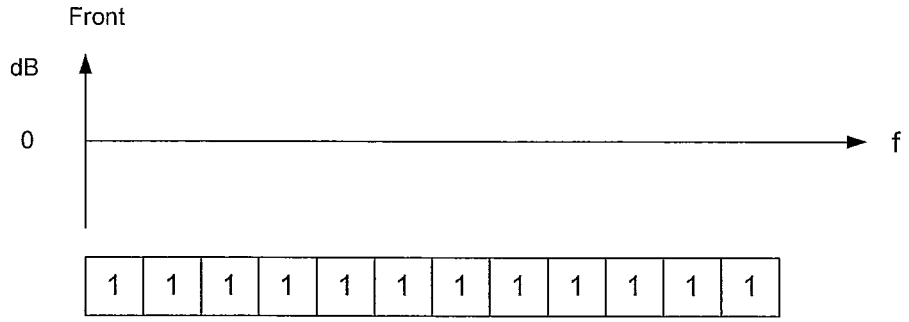
Figure 5B:
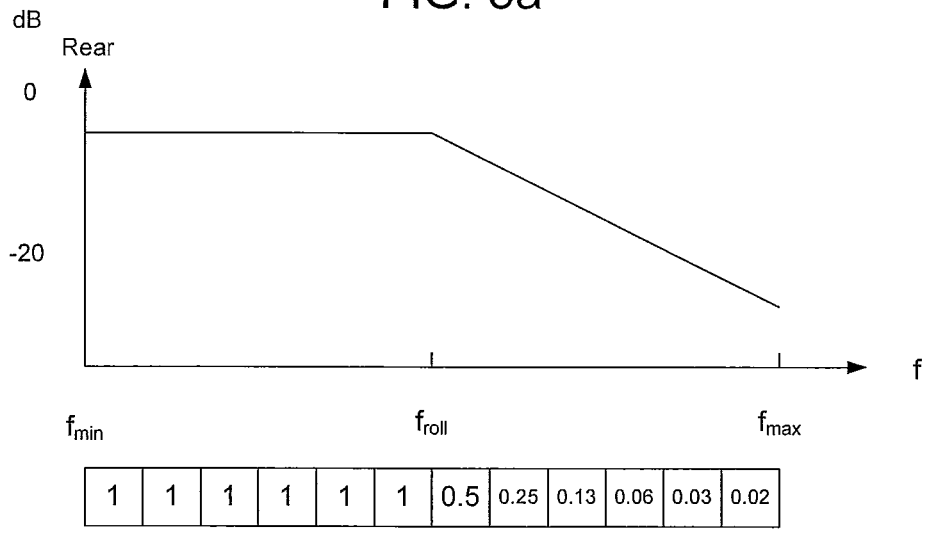
Figure 5C:
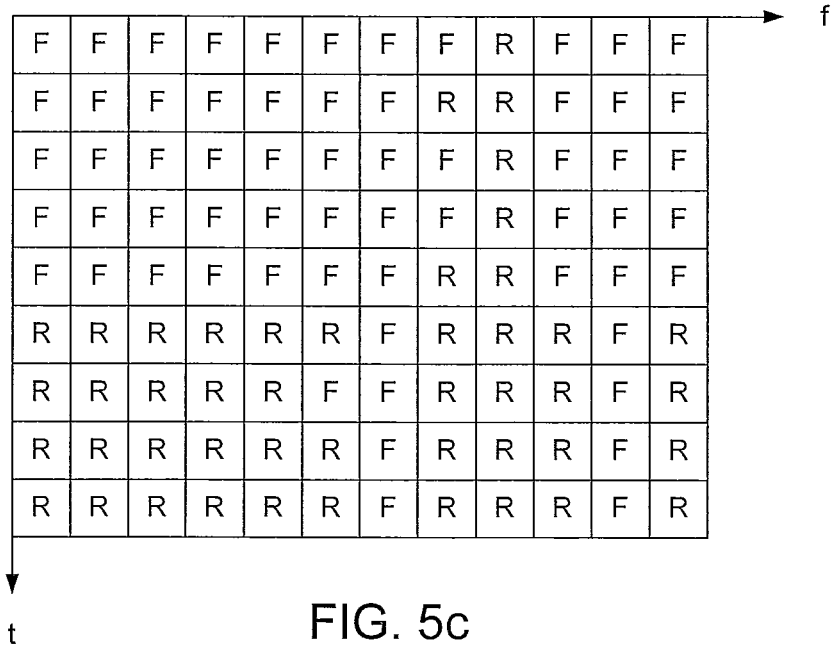

FIG. 5 illustrates an example of FRONT (FIG. 5*a*) and REAR directional cues (FIG. 5*b*) and a directional time-frequency representation of an input signal (FIG. 5*c*) according to an embodiment of the invention. An artificial directional cue in the form of a forced attenuation of a directional signal originating from the REAR can preferably be introduced. In FIGS. 5*a* and 5*b*, corresponding exemplary directional gain cues, i.e. gain vs. frequency, are illustrated. FIG. 5*a* shows a flat FRONT gain cue graph $GC_{from}(f)$ [dB]=0 dB, f being frequency (here illustrated by splitting the frequency range considered $f_{min}$–$f_{max}$ in 12 frequency bands, $f_1, f_2, \ldots, f_{12}$). A corresponding FRONT cue gain vector $GC_{front}(p)=1$ (linear), p=1, 2, . . . , 12 is shown. FIG. 5*b* shows a REAR gain cue graph $GC_{rear}(f)$ [dB] having a flat part below a roll-off frequency $f_{roll}$ and a roll-off in the form of an increasing attenuation (here a linearly increasing attenuation (or decreasing gain) on a logarithmic scale [dB]) at frequencies larger than $f_{roll}$. The roll-off frequency is preferably adapted to a user's hearing profile to ensure that the decreasing gain beyond $f_{roll}$ constituting a REAR gain cue is perceivable to the user. A corresponding REAR cue gain vector $GC_{rear}(P)=1$, p=1, 2, . . . , 6, $GC_{rear}(P)=1/2^{(p-6)}$, p=7, 8, . . . , 12 is shown (linear). Here, the roll-off frequency $f_{roll}=f_6$. FIG. 5*c* shows a time frequency map based on a FRONT and REAR directional signal, F or R in a specific TF-unit indicating that the signal component of the TF-unit originates from a FRONT or REAR direction, respectively, relative to a user as determined by a decision algorithm based on the corresponding FRONT and REAR directional signals. 'F' and 'R' may e.g. be replaced by a 1 and 0, respectively, or by a 0 and 1, respectively, as the case may be. The frequency range considered may comprise a smaller or larger amount of frequency ranges or bands than 12, e.g. 8 or 16 or 32 or 64 or more. The minimum frequency $f_{min}$ considered may e.g. be in the range from 10 to 30 Hz, e.g. 20 Hz. The maximum frequency $f_{max}$ considered may e.g. be in the range from 6 kHz to 30 kHz, e.g. 8 kHz or 12 kHz or 16 kHz or 20 kHz. The roll-off frequency $f_{roll}$ may e.g. be in the range from 2 kHz to 8 kHz, e.g. around 4 kHz. The gain reduction may e.g. be in the range from 10 dB/decade to 40 dB/decade, e.g. around 20 dB/decade.

Figure 6A:
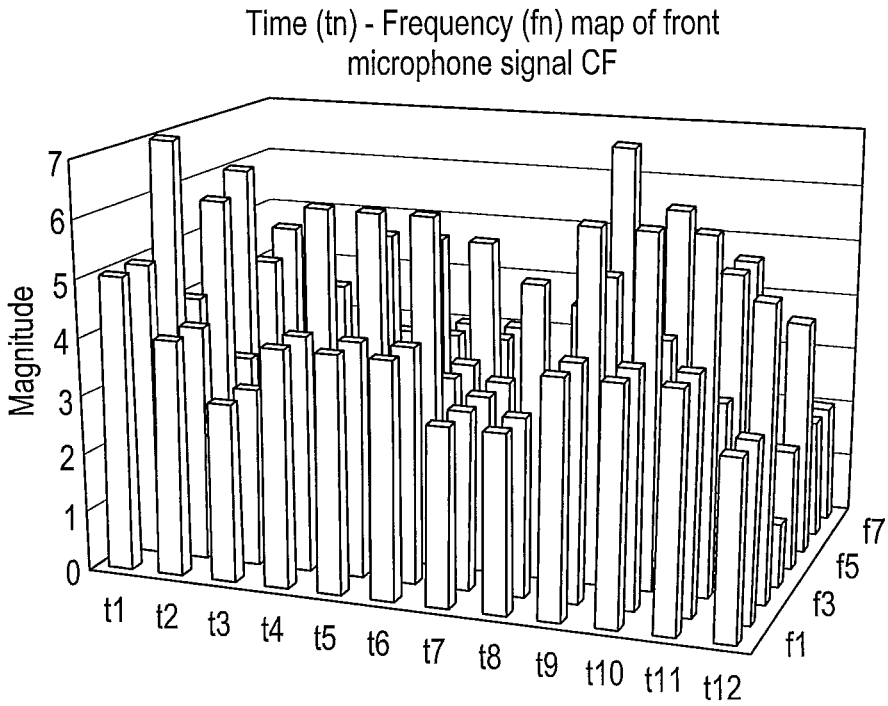
FIG. 6 shows a time frequency representation of a FRONT and REAR microphone signal, CF and CR, respectively, (FIG. 6*a*), a differential microphone signal CF-CR (FIG. 6*b*), and a binary time-frequency mask representation of the differential microphone signal (FIG. 6*c*)
Figure 6A:
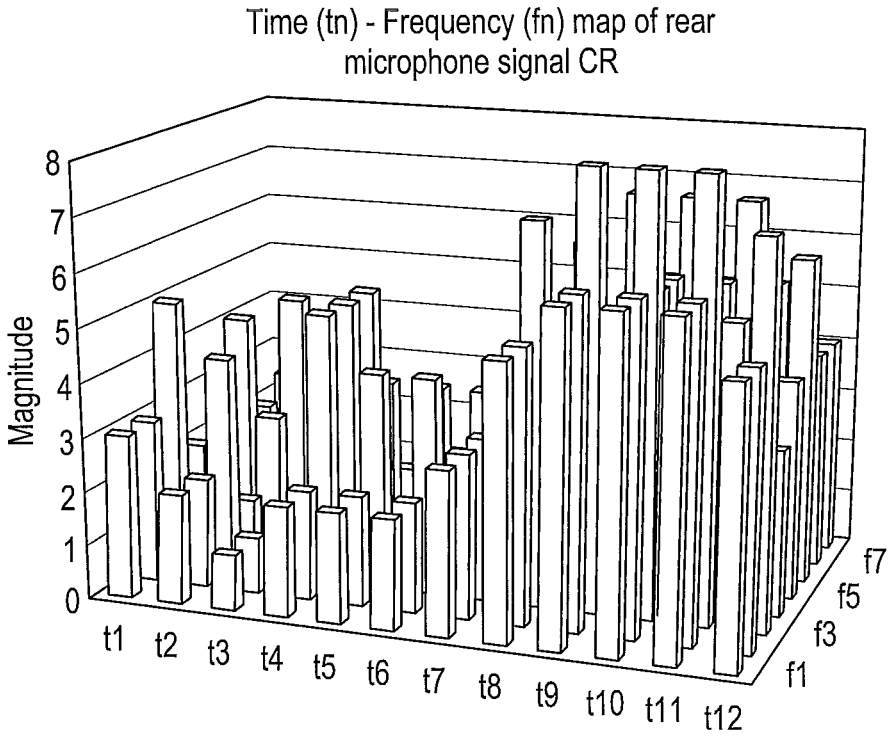
Figures 6B, 6C:
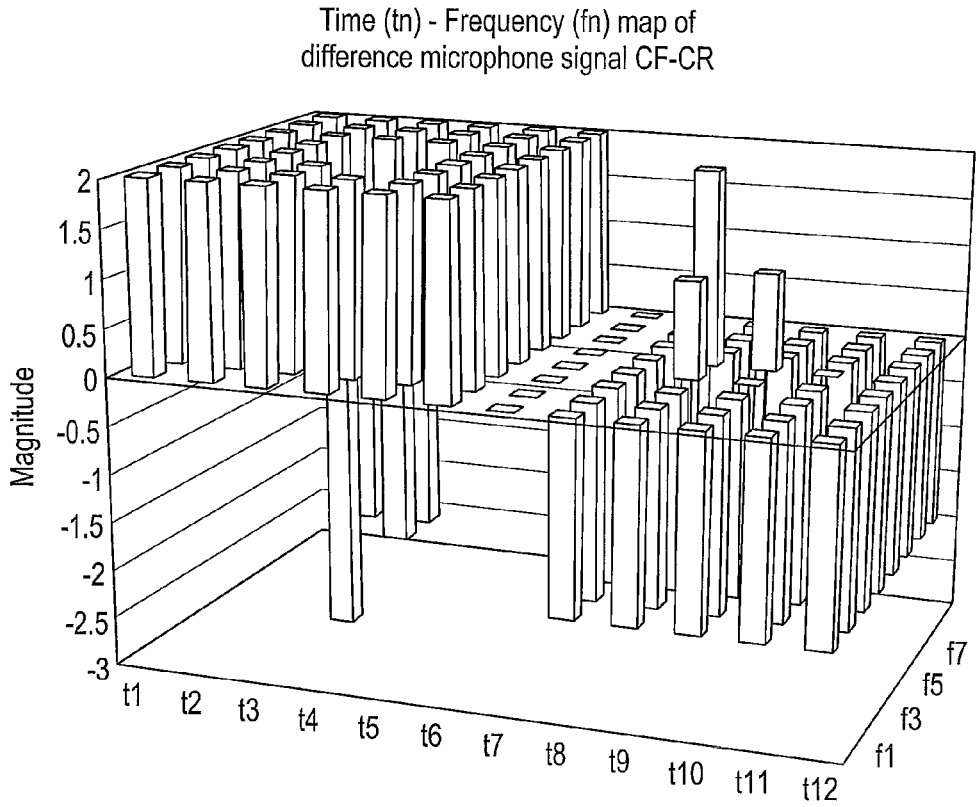

FIG. 6 shows a time frequency representation of a FRONT and REAR microphone signal, CF and CR, respectively, (FIG. 6*a*), a differential microphone signal CF−CR (FIG. 6*b*), and a binary time-frequency mask representation of the differential microphone signal (FIG. 6*c*). The frequency range considered is divided in 8 frequency ranges or bands, each comprising a single frequency $f_p$, p=1, 2, . . . , 8. Frequency spectra $f_p$ determined at a number of consecutive time instances $t_m$, m=1, 2, . . . , 12 constitute a time-frequency map TF(m,p), each TF-unit(m,p) comprising a magnitude value of the signal (in an arbitrary scale) at that frequency p and time unit m. FIG. 6*a* shows exemplary corresponding time-frequency maps $TF_{front}(m,p)$ and $TF_{rear}(m,p)$, each mapping magnitudes |CF(m,p)| and |CR(m,p)|, e.g. in a logarithmic scale [dB]. A sound signal from a FRONT direction predominates in time units m=1-6, whereas a sound signal from a REAR direction predominates in time units m=8-12 as illustrated in the TF-map of the differential signal |CF|−|CR| in FIG. 6*b*. A binary TF-map, BTM, of the differential signal |CR|−|CF| defined by the criterion IF |CR(m,p)|−|CF(m,p)|>0, BTM(m,p)=1, ELSE BTM(m,p)=0, m=1, 2, . . . , 12, p=1, 0.2, . . . , 8 is shown in FIG. 6*c*. As it appears, in the shown time frames, the sound signal sources are predominantly FRONT in the first 6 time frames and predominantly originating from the REAR in the last 6 time frames. There are however, a few TF-units in the first 6 time frames that originate from the REAR and a few TF-units in the last 6 time frames that originate from the FRONT. This represents one of the strengths of the TF-masking method that the processing can be performed on each individual TF-unit.

Figure 7A:
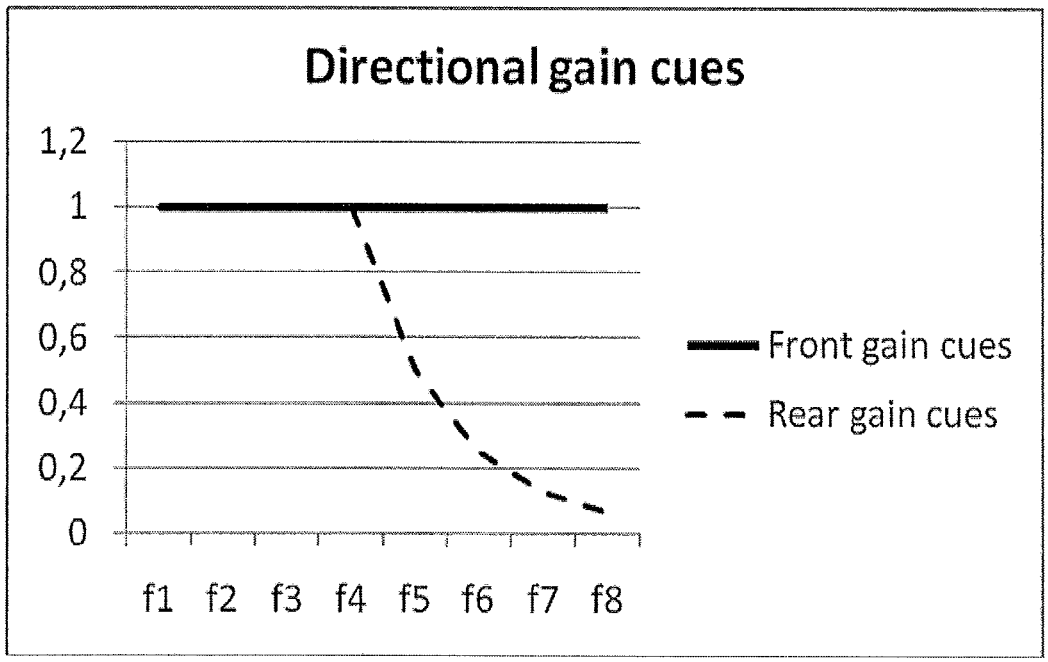
FIG. 7 shows various exemplary directional cues (linear scale) for introduction in FRONT and REAR microphone signals according to an embodiment of the invention, FIG. 7*a* illustrating a decreasing gain beyond a roll-off frequency for a signal originating from a REAR direction, and FIGS. 7*b* and 7*c* directional cues in the form of peaks or notches at predefined frequencies in the FRONT and/or REAR signals, respectively.
Figure 7B:
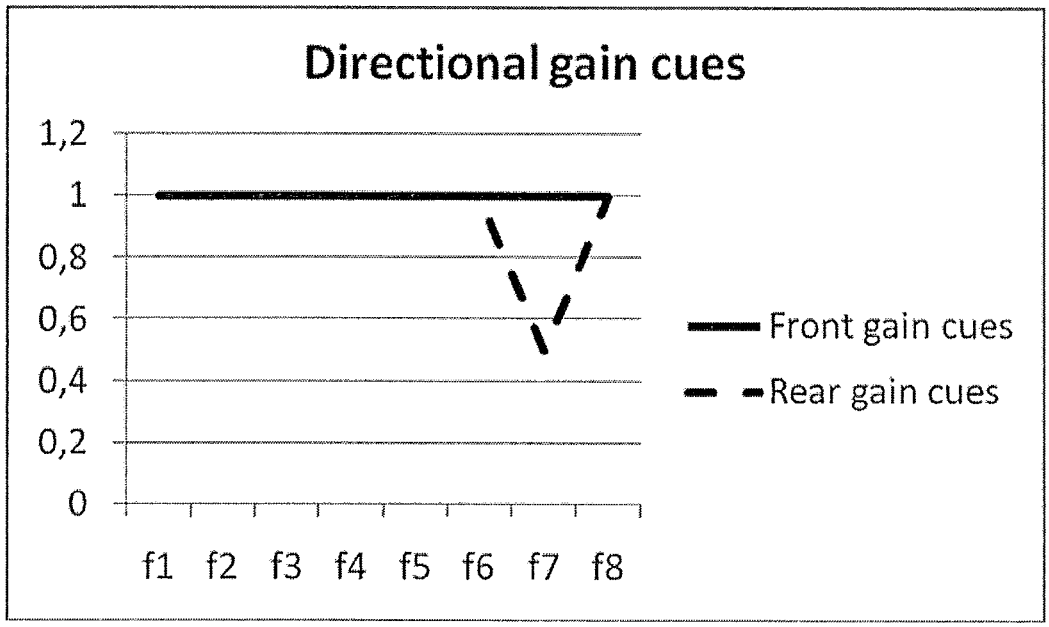
Figure 7C:
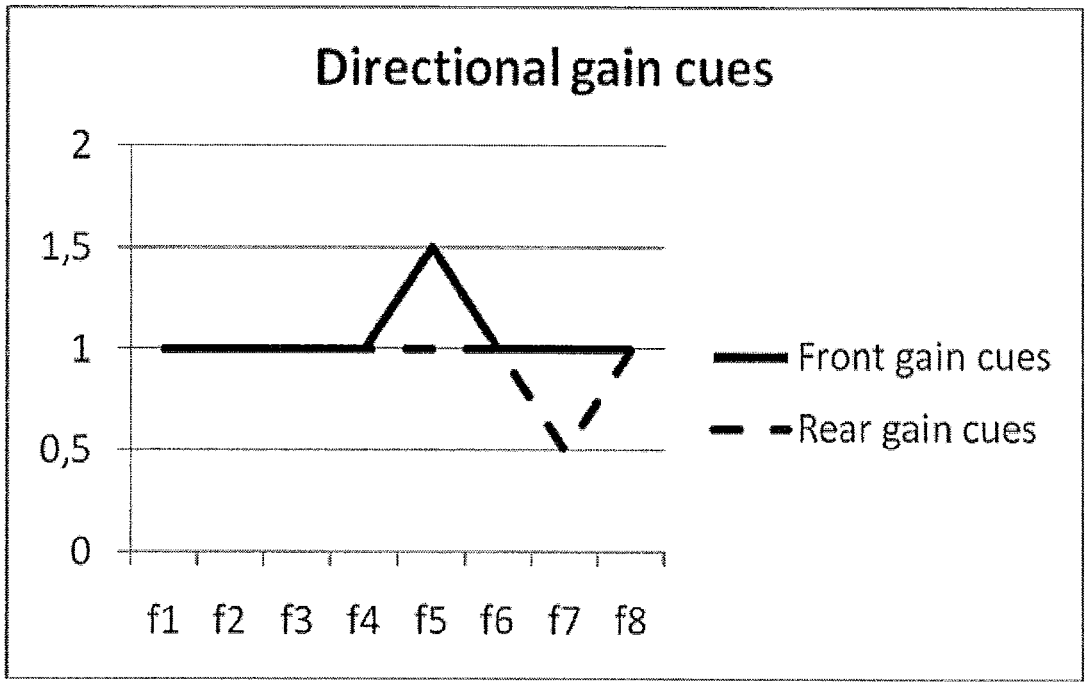

FIG. 7 shows various exemplary directional cues (linear scale) for introduction in FRONT and REAR microphone signals according to an embodiment of the invention, FIG. 7*a* illustrating a decreasing gain beyond a roll-off frequency for a signal originating from a REAR direction, and FIGS. 7*b* and 7*c* directional cues in the form of peaks or notches at predefined frequencies in the FRONT and/or REAR signals, respectively. The frequency range considered is divided in 8 frequency ranges or bands, each comprising a single frequency $f_p$, p=1, 2, . . . , 8. FIG. 7*a* illustrates a flat unity gain for signals from a FRONT direction and a flat unity gain up to roll-off frequency $f_{roll}=f_4$ with a decreasing gain above the roll-off frequency (similar to FIG. 5*a*, 5*b*). FIG. 7*b* shows a flat unity gain for signals from a FRONT direction and a REAR directional cue in the form of a notch at a frequency $f_7$. FIG. 7*c* shows a FRONT directional cue in the form of a peak at a frequency $f_5$ and a REAR directional cue in the form of a notch at a frequency $f_7$. Other directional cues may be envisaged, e.g. comprising more than one peak or notch at different frequencies or comprising a mixture of one or more peaks and one or more notches at different frequencies. In an embodiment, natural cues as e.g. illustrated in FIG. 1 are modelled, e.g. as a number of notches (e.g. 3-5) at frequencies above 5 kHz. In an embodiment, the magnitudes in dB of the notches are around 20 dB. In an embodiment, magnitude in dB of the notches is increased compared to their natural values, e.g. to more than 30 dB, e.g. in dependence of a user's hearing impairment at the frequencies in question. In an embodiment, the notches (or peaks) are 'relocated' to lower frequencies than their natural appearance (e.g. depending on the user's hearing impairment at the frequencies in question). In an embodiment, the notches (or peaks) are wider than the naturally occurring directional cues, effectively band-attenuating filters, e.g. depending on the frequency resolution of the hearing impaired user. In an embodiment, the notches (or peaks) extend over more than one frequency band in width, e.g. more than 4 or 8 bands. In an embodiment, the notches (or peaks) are in the range from 100 Hz to 3 kHz in width, e.g. between 500 Hz and 2 kHz.

Figure 8A:
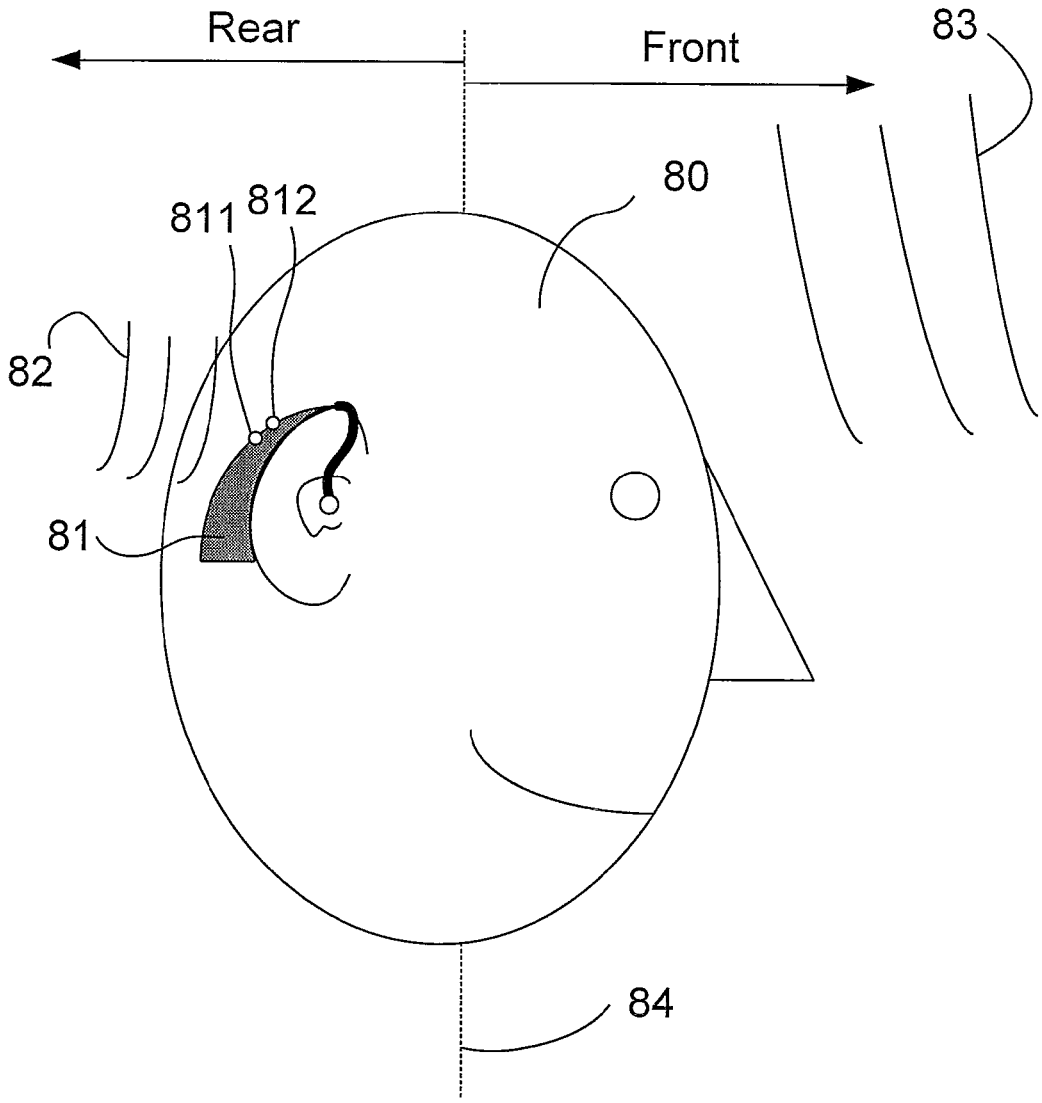
FIG. 8 shows embodiments of a listening device comprising an ear-part adapted for being worn at an ear of a user, FIG. 8*a* comprising a BTE-part comprising two microphones, FIG. 8*b* comprising a BTE-part comprising two microphones and a separate, auxiliary device comprising at least a third microphone.
Figure 8B:
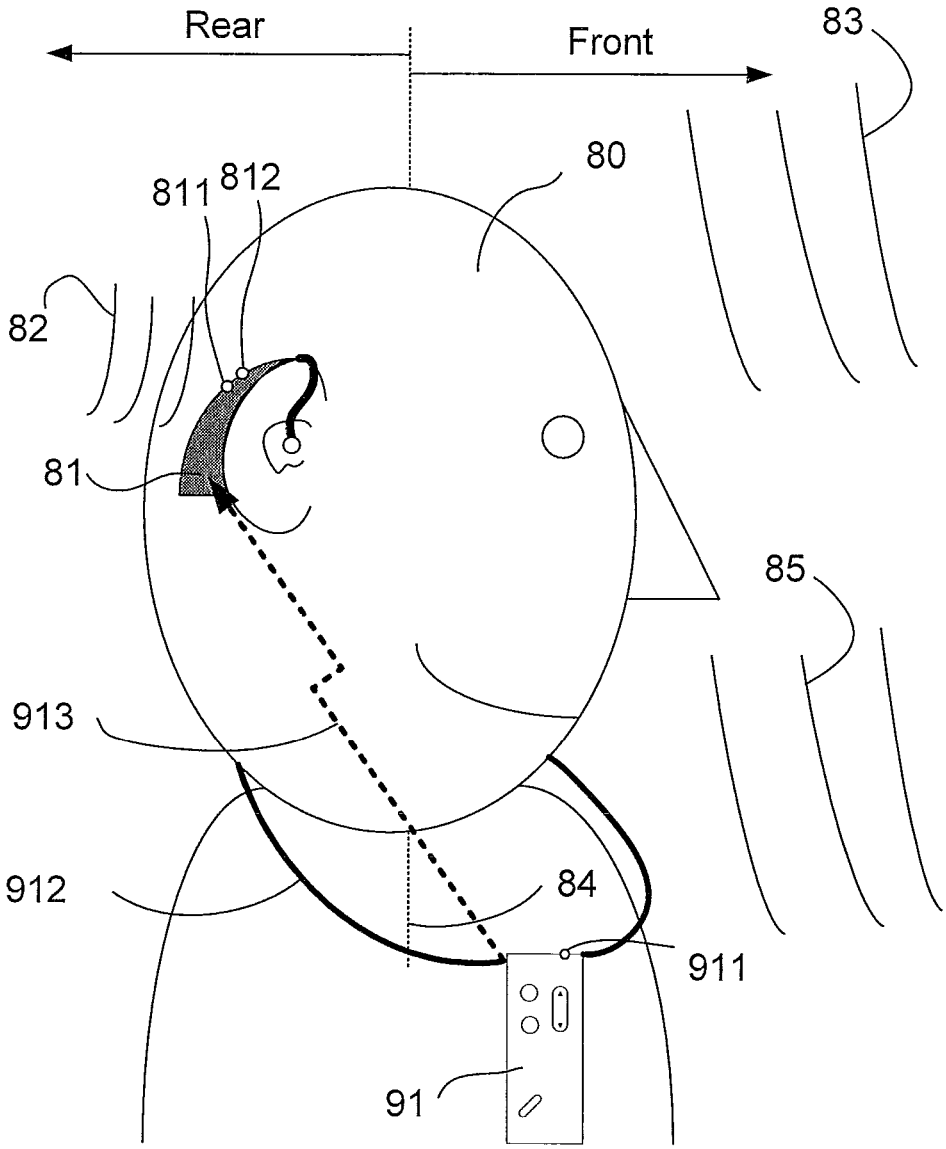

FIG. 8 shows embodiments of a listening device comprising an ear-part adapted for being worn at an ear of a user, FIG. 8*a* comprising a BTE-part comprising two microphones, FIG. 8*b* comprising a BTE-part comprising two microphones and a separate, auxiliary device comprising at least a third microphone. In FIGS. 8*a* and 8*b*, the face of a user 80 wearing the ear-part 81 of a listening device, e.g. a hearing instrument, in an operational position (at or behind an outer ear (pinna) of the person) defines a FRONT and REAR direction relative to a vertical plane 84 through the ears of the user (when sitting or standing upright).

In the embodiment of FIG. 8*a*, the listening device comprises a directional microphone system comprising two microphones 811, 812 located on the ear part 81 of the device. The two microphones 811, 812 are located on the ear-part to pick up sound fields 82, 83 from the environment. In the scene of FIG. 8*a*, sound fields 82 and 83 originating from, respectively, REAR and FRONT halves of the environment relative to the user 80 (as defined by plane 84) are present.

FIG. 8*b* shows an embodiment of a listening device according to the invention comprising the listening device of FIG. 8*a*. The microphone system of the listening device in FIG. 8*b* further comprises a microphone 911 located on a physically separate device (here an audio gateway device 91) adapted for communicating with the listening device, e.g. via an inductive link 913, e.g. via a neck-loop antenna 912. In the scene of FIG. 8*b*, sound fields 82, 83 and 85 originating from, respectively, REAR (82) and FRONT (83, 85) halves of the environment relative to the user 80 (as defined by plane 84) are present. The use of a microphone located at another, separate, device has the advantage of providing a different 'picture' of the sound field surrounding the user.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims. For example, in the described embodiments, reference is generally made to two directions, FRONT and REAR. Other directions than FRONT and REAR relative to a user could be used depending on the application in question. Further, more than two directions may be used without deviating from the general concepts of the present invention.

REFERENCES

US 2007/0061026 A1 (Wang) 15 Mar. 2007
EP 1 443 798 A2 (PHONAK) 4 Aug. 2004
US 2007/230729 A1 (OTICON) 4 Oct. 2007
US 2009/0074197 A1 (OTICON) 19 Mar. 2009
WO 99/09786 A1 (PHONAK) 25 Feb. 1999
U.S. Pat. No. 5,473,701 (AT&T) 5 Dec. 1995
EP 1 579 728 B1 (OTICON) 8 Jul. 2004
[Middlebrooks, 1999] Middlebrooks, J. C., Individual differences in external-ear transfer functions reduced by scaling in frequency", J. Acoust. Soc. Am., Vol. 106 (3), pp. 1480-1492, 1999.
[Blauert et al., 1997] Jens Blauert, John S. Allen, Spatial hearing: the psychophysics of human sound localization, Edition: 2, revised, 494 pages, Published by MIT Press, 1997, ISBN 0262024136, 9780262024136.
[Wang, 2005] Wang, D. On ideal binary mask as the computational goal of auditory scene analysis, Divenyi P (ed): Speech Sepearation by Humans and Machines, pp 181-197 (Kluwer, Norwell, Mass. 2005).

The invention claimed is:

1. A listening device, comprising:

an ear-part adapted for being worn in or at an ear of a user, a front and rear direction being defined relative to a person wearing the ear-part in an operational position;

a microphone system comprising at least two microphones each converting an input sound to an electrical microphone signal;

a TF-conversion unit for providing a time-frequency representation of the at least two microphone signals, each signal representation comprising corresponding complex or real values of the signal in question in a particular time-frequency unit;

a DIR-unit comprising a directionality system for providing a weighted sum of the at least two electrical microphone signals thereby providing at least two directional microphone signals having maximum sensitivity in spatially different directions and a combined microphone signal, each time-frequency unit of the combined signal being attributable to a particular direction; and a frequency shaping-unit for modifying one or more selected time-frequency units of the combined microphone signal to indicate directional cues of input sounds originating from at least one of said spatially different directions and providing an improved directional output signal.

2. A listening device according to claim 1 comprising an analogue to digital converter unit providing said electrical microphone signals as digitized electrical microphone signals.

3. A listening device according to claim 1 wherein the frequency shaping unit is adapted to move the directional cues of a given time frequency range to a relatively lower frequency range.

4. A listening device according to claim 3 where differences in the directional microphone signals attributable to directional cues are moved from relatively higher to relatively lower frequencies.

5. A listening device according to claim 4 wherein said directional cues are increased in magnitude.

6. A listening device according to claim 1 wherein the frequency shaping unit is adapted to modify one or more selected time frequency ranges to provide a directional frequency shaping of the combined microphone signal in dependence of the direction of the incoming sound signal.

7. A listening device according to claim 1, wherein the frequency shaping unit is adapted to provide the directional frequency shaping of the combined microphone signal in dependence of a users hearing ability.

8. A listening device according to claim 1, wherein the directional frequency shaping of the combined microphone signal comprises a roll off of the directional microphone signal corresponding to a rear direction of the user above a predefined ROLL-OFF-frequency.

9. A listening device according to claim 1 wherein the directional frequency dependent shaping comprises inserting a peak or a notch at a REAR-frequency in the resulting improved directional output signal indicative of sound originating from a rear direction of the user.

10. A listening device according to claim 8, wherein the REAR-frequency is larger than or equal to 3 kHz.

11. A listening device according to claim 1 wherein the ear-part comprises a BTE-part adapted to be located behind an ear of a user, the BTE-part comprising at least one microphone of the microphone system.

12. A listening device according to claim 1, wherein the frequency shaping-unit is adapted to provide that a frequency shaping is applied to the combined microphone signal based on a decision of whether a particular instance in time and frequency has its origin from a particular direction.

13. A listening device according to claim 1 wherein the frequency shaping-unit is adapted to implement a decision algorithm for deciding whether or not or with which probability or weight a given TF-range or unit is associated with a given spatial direction.

14. A listening device according to claim 13, wherein the decision algorithm for each TF-range or unit is $|CF|-|CR| \geqq \tau$, in a logarithmic expression, where $|CF|$ and $|CR|$ are the magnitudes of the front and rear directional signals, respectively, and $\tau$ is a directional bias constant.

15. A method of operating a listening device, the listening device comprising an ear-part adapted for being worn in or at an ear of a user, a front and rear direction being defined relative to a person wearing the ear-part in an operational position, the method comprising:

providing at least two microphones signals, each being an electrical representation of an input sound;

providing a time-frequency representation of the at least two microphone signals, each signal representation comprising corresponding complex or real values of the signal in question in a particular time-frequency unit;

providing a weighted sum of the at least two electrical microphone signals resulting in at least two directional microphone signals having maximum sensitivity in spatially different directions in said front and rear directions, and a combined microphone signal, each time-frequency unit of the combined signal being attributable to a particular direction; and modifying one or more selected time-frequency units of the combined microphone signal to indicate the directional cues of input sounds originating from at least one of said spatially different directions and providing an improved directional output signal.

16. A tangible non-transitory computer-readable medium storing a computer program comprising program instructions for causing a data processing system to perform a method of operating a listening device, the listening device comprising an ear-part adapted for being worn in or at an ear of a user, a front and rear direction being defined relative to a person wearing the ear-part in an operational position, wherein the method comprises:

providing at least two microphones signals, each being an electrical representation of an input sound;

providing a time-frequency representation of the at least two microphone signals, each signal representation comprising corresponding complex or real values of the signal in question in a particular time-frequency unit;

providing a weighted sum of the at least two electrical microphone signals resulting in at least two directional microphone signals having maximum sensitivity in spatially different directions in said front and rear directions, and a combined microphone signal, each time-frequency unit of the combined signal being attributable to a particular direction; and modifying one or more selected time-frequency units of the combined microphone signal to indicate the directional cues of input sounds originating from at least one of said spatially different directions and providing an improved directional output signal.

17. A listening device according to claim 1, further comprising:

an electrical interface to another device allowing reception or interchange of data from the other device via a wired or wireless connection.

18. A listening device according to any one of claim 1, further comprising:

a hearing instrument adapted for being worn at or in an ear and providing a frequency dependent gain of the input sound.

* * * * *